US012398966B2

(12) United States Patent
Kim

(10) Patent No.: US 12,398,966 B2
(45) Date of Patent: Aug. 26, 2025

(54) BACKWARD COMPATIBLE SAFETY SLIDE FIRING PIN-STRIKER SYSTEM

(71) Applicant: 4SEP18, LLC, Laguna Niguel, CA (US)

(72) Inventor: Kyung Tae Kim, Laguna Niguel, CA (US)

(73) Assignee: 4SEP18, LLC, Laguna Niguel, CA (US)

( * ) Notice: Subject to any disclaimer, the term of this patent is extended or adjusted under 35 U.S.C. 154(b) by 0 days.

(21) Appl. No.: 19/017,927

(22) Filed: Jan. 13, 2025

(65) Prior Publication Data

US 2025/0237450 A1 Jul. 24, 2025

Related U.S. Application Data

(60) Provisional application No. 63/624,297, filed on Jan. 24, 2024.

(51) Int. Cl.

| | |
|---|---|
| ***F41A 11/00*** | (2006.01) |
| ***F41A 17/02*** | (2006.01) |
| ***F41A 17/56*** | (2006.01) |
| ***F41A 17/64*** | (2006.01) |

(52) U.S. Cl.

CPC ..... *F41A 11/00* (2013.01); *F41A 17/02* (2013.01); *F41A 17/56* (2013.01); *F41A 17/64* (2013.01)

(58) Field of Classification Search

CPC ..... F41A 17/02; F41A 17/56; F41A 17/64; F41A 11/00

See application file for complete search history.

(56) References Cited

U.S. PATENT DOCUMENTS

| | | | | |
|---|---|---|---|---|
| 4,590,697 A | | 5/1986 | Ruger et al. | |
| 5,493,806 A | * | 2/1996 | Langevin | F41A 19/13 42/70.08 |
| 6,240,670 B1 | | 6/2001 | Findlay | |
| 6,338,217 B1 | * | 1/2002 | Viani | F41A 17/02 42/70.11 |
| 6,357,155 B1 | * | 3/2002 | Amadini | F41A 17/02 42/70.11 |

(Continued)

FOREIGN PATENT DOCUMENTS

| | | | | |
|---|---|---|---|---|
| DE | 102013022082 B3 | * | 10/2014 | F41A 17/72 |
| WO | WO-0140732 A1 | * | 6/2001 | F41A 17/02 |

OTHER PUBLICATIONS

International Search Report and Written Opinion for International Patent Application No. PCT/US2025/011420, dated Apr. 8, 2025, 5 pages.

*Primary Examiner* — Gabriel J. Klein

(74) *Attorney, Agent, or Firm* — Fish IP Law, LLP; Tomas A. Prieto

(57) ABSTRACT

A firearm system which allows firearm disassembly without trigger actuation. The system includes a slide having a divot or cavity disposed laterally off of the main channel. This divot allows for the pivoting of the striker sleeve such that the striker tang sear can move between a first position that is engaged with a corresponding trigger bar sear of a frame and a second position whereby the striker tang sear is disposed at least partially within the divot. This allows the striker tang sear to clear the trigger bar sear for disassembly without requiring a pull of the trigger.

5 Claims, 17 Drawing Sheets

(56) References Cited

U.S. PATENT DOCUMENTS

| | | | | |
|---|---|---|---|---|
| 6,363,646 | B1 * | 4/2002 | Amadini | F41A 17/02 42/70.11 |
| 6,405,470 | B1 * | 6/2002 | Strahan | F41A 17/02 42/70.11 |
| 6,510,641 | B1 * | 1/2003 | Viani | F41A 17/02 42/70.11 |
| 6,865,979 | B1 * | 3/2005 | Vaid | F41A 11/00 89/144 |
| 2018/0245868 | A1 * | 8/2018 | Dechant | F41A 3/64 |
| 2018/0259284 | A1 | 9/2018 | Novak | |
| 2020/0240732 | A1 * | 7/2020 | Kim | F41A 17/64 |

* cited by examiner

Detail A

Detail B

Fig. 18
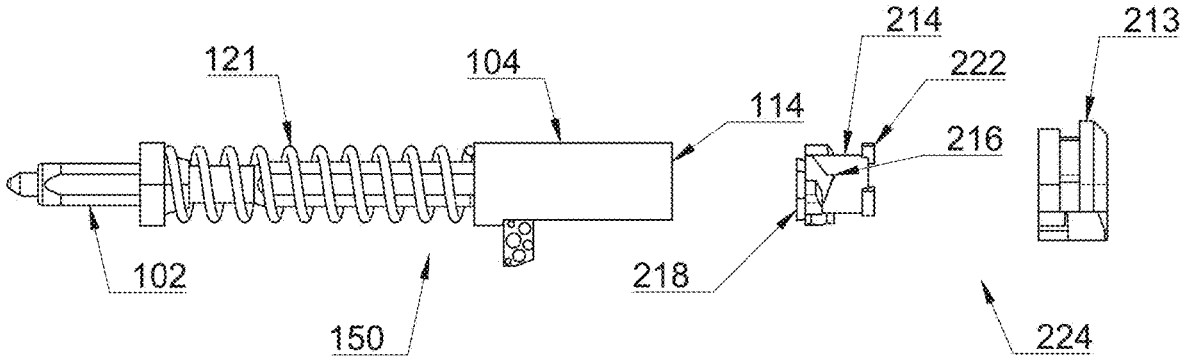
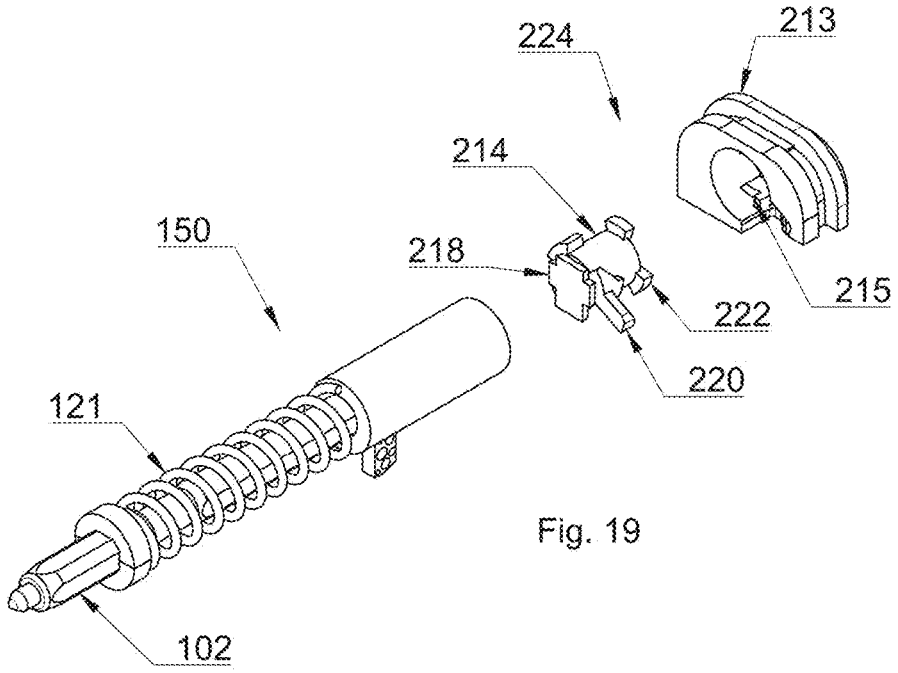
Fig. 19

Detail C

Detail D

Detail E

BACKWARD COMPATIBLE SAFETY SLIDE FIRING PIN-STRIKER SYSTEM

This application claims priority to U.S. provisional application 63/624,297, filed Jan. 24, 2024. U.S. provisional application 63/624,297 and all other extrinsic references contained herein are incorporated by reference in their entirety.

FIELD OF THE INVENTION

The field of the invention is firearms and firearm safety.

BACKGROUND

The background description includes information that may be useful in understanding the present invention. It is not an admission that any of the information provided herein is prior art or relevant to the presently claimed invention, or that any publication specifically or implicitly referenced is prior art.

A popular firearm design requires trigger actuation for field stripping/disassembly. This could result in unintended discharge if the firearm was not properly cleared of live ammunition before disassembly. An unintended discharge of a loaded firearm could cause serious injury or death.

Thus, there is still a need for a safe way to disassemble a firearm that doesn't require a trigger pull.

SUMMARY OF THE INVENTION

The inventive subject matter provides apparatus, systems and methods in which a slide for a firearm includes a divot disposed laterally from its central channel and aligned such that a striker tang sear which is coupled to a striker sleeve disposed within the channel can move from a first position (engaged with a trigger bar sear of the firearm frame) to a second position at least partially within the divot.

When the striker tang sear is at the second position, it clears the trigger bar sear when the slide is moved forward along the length of the firearm, allowing for easy removal of the slide without requiring trigger activation.

The inventive subject matter further includes a backplate that includes a rotatable lock. The rotatable lock engages with the striker sleeve such that the rotation of the lock causes a corresponding rotation of the striker sleeve (and thus, the movement of the coupled striker tang sear between the first and second positions).

The rotatable lock can include an actuation element that can be used by the user to rotate the rotatable lock. The actuation element can be a groove, a shaped cavity, a textured surface, an externally-extending tab(s), or other type of user friendly form that allows for easy rotation of the lock.

Various objects, features, aspects and advantages of the inventive subject matter will become more apparent from the following detailed description of preferred embodiments, along with the accompanying drawing figures in which like numerals represent like components.

All publications identified herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

The following description includes information that may be useful in understanding the present invention. It is not an admission that any of the information provided herein is prior art or relevant to the presently claimed invention, or that any publication specifically or implicitly referenced is prior art.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

Unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

BRIEF DESCRIPTION OF THE DRAWING

FIG. 18 is a left side view of FIG. 16.

FIG. 19 is a front-left-top isometric view of FIG. 16.

DETAILED DESCRIPTION

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

Figure 1:
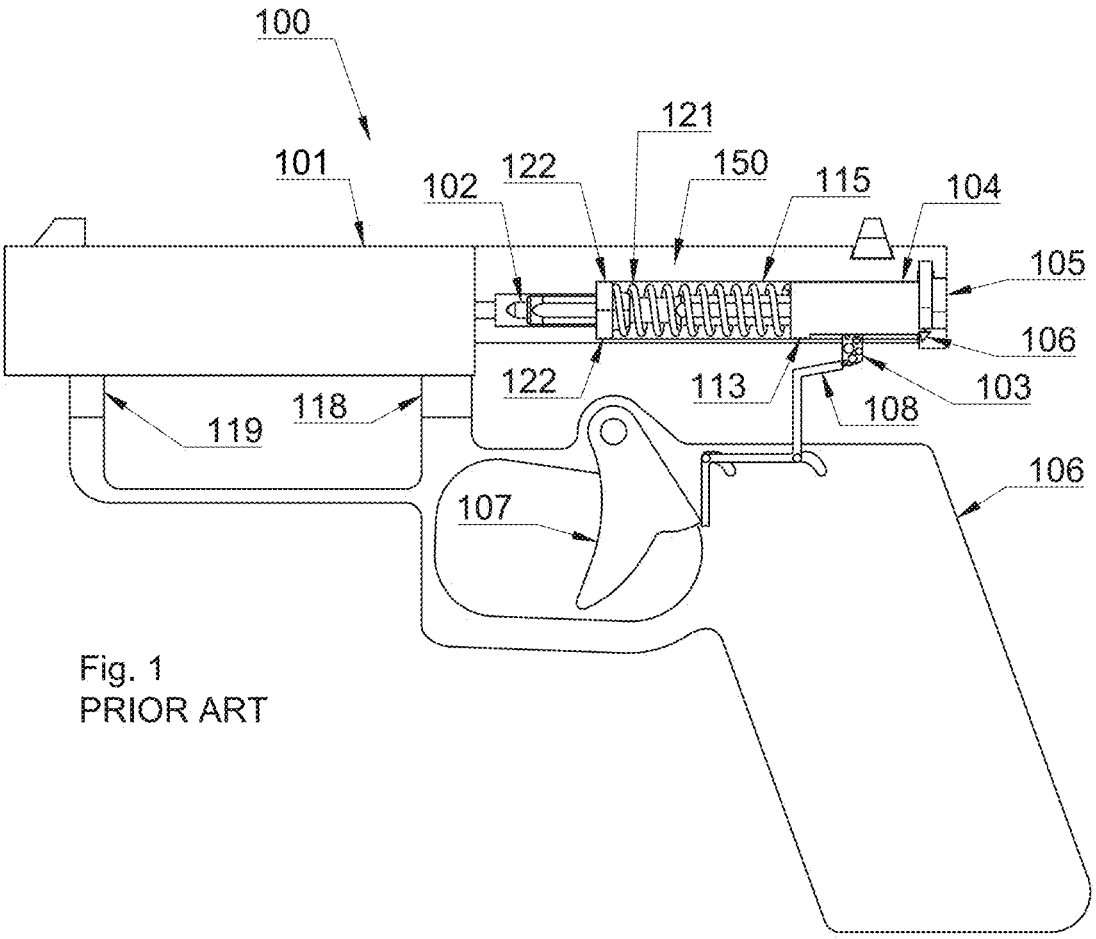
Fig. 1 PRIOR ART
FIG. 1 is a left side (partial cutaway, muzzle toward left side of page) view of a Prior Art Slide Firing Pin/Striker System of a popular type of firearm in a Pre Disassembly Initiated State.

FIG. 1 is a left side view of a Prior Art Slide Firing Pin/Striker System 100 (hereinafter "System 100") of a popular type of firearm in a "Pre Disassembly Initiated State". The Pre Disassembly Initiated State can be considered to be the state of normal use of the firearm. This is prior to taking any steps necessary for the disassembly of the weapon.

System 100 can be considered to comprise a Prior Art Slide 101 (hereinafter "Slide 101") which includes a Firing Pin/Striker Assembly 150 and a Prior Art Backplate 105.

A Striker 102, two Half Clam Spring Capture Cups 122, Spring 121 and Striker Sleeve 104 make up the Firing Pin/Striker Assembly 150.

Figure 3:
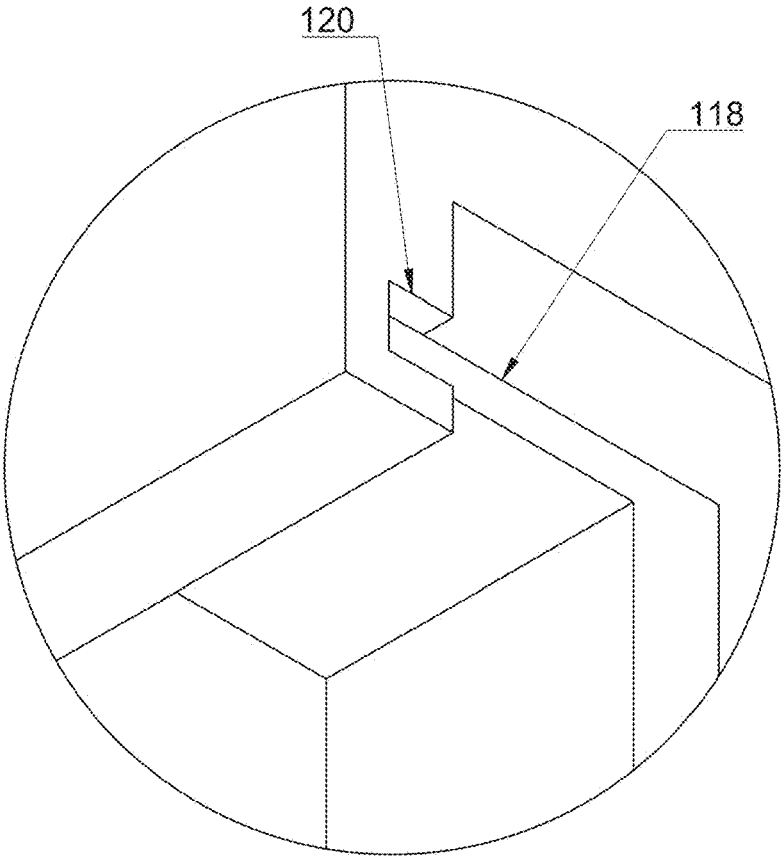
FIG. 3 is a detailed view of Section A of FIG. 2.

Slide 101 further comprises Striker Channel 115 and Prior Art Slide Rail Grooves 120 (visible in FIG. 3).

Striker 102 further comprises a Striker Tang Sear 103 (shown "cheese-holed" for illustrative clarity).

System 100 is functionally coupled with a Frame 106 of the firearm. Frame 106 further comprises Trigger 107, trigger bar Sear 108, Front Frame Rails 119 and Aft Frame Rails 118.

Frame 106 is illustrated as 2 separate pieces (for illustrative ease only). In practice, the small upside down pyramid is connected to the main body of the Frame 106.

During normal operations, the actuation of Trigger 107 causes trigger bar Sear 108 to compress Spring 121 (thus imparting potential energy into the Spring 121). Additional/further actuation of Trigger 107 causes trigger bar Sear 108 to release Striker 102 which allows the Spring's potential energy to convert to kinetic energy. Kinetic energy of the released Striker 102 then discharges ammunition chambered in the firearm. Subsequent force of discharging gunpowder gases initiates a cycling process which (in a known manner) ejects the spent ammunition case, chambers live ammunition, and resets the system for subsequent Trigger 107 actuation.

Figure 2:
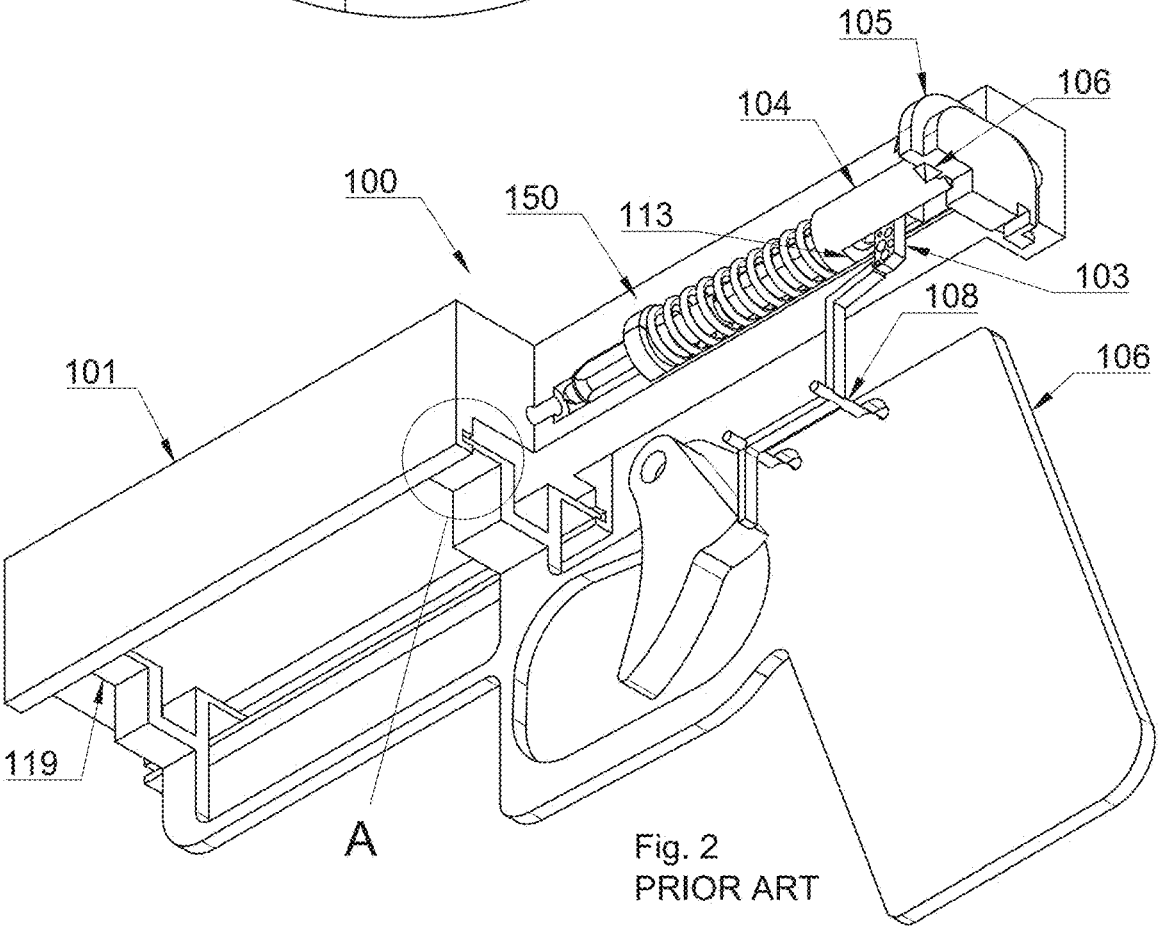
Fig. 2 PRIOR ART
FIG. 2 is a rear-left-bottom isometric view of FIG. 1.

FIG. 2 is a rear-left-bottom isometric view of FIG. 1.

FIG. 3 is a detailed view of Section A of FIG. 2. It is important to note that System 100 is fixed in the Y Axis (i.e.—only moves along the length of the firearm and not allowed to displace up/down) from Frame 106 due to the communication between Frame Rails (118/119) and Prior Art Slide Rail Grooves 120.

Figure 4:
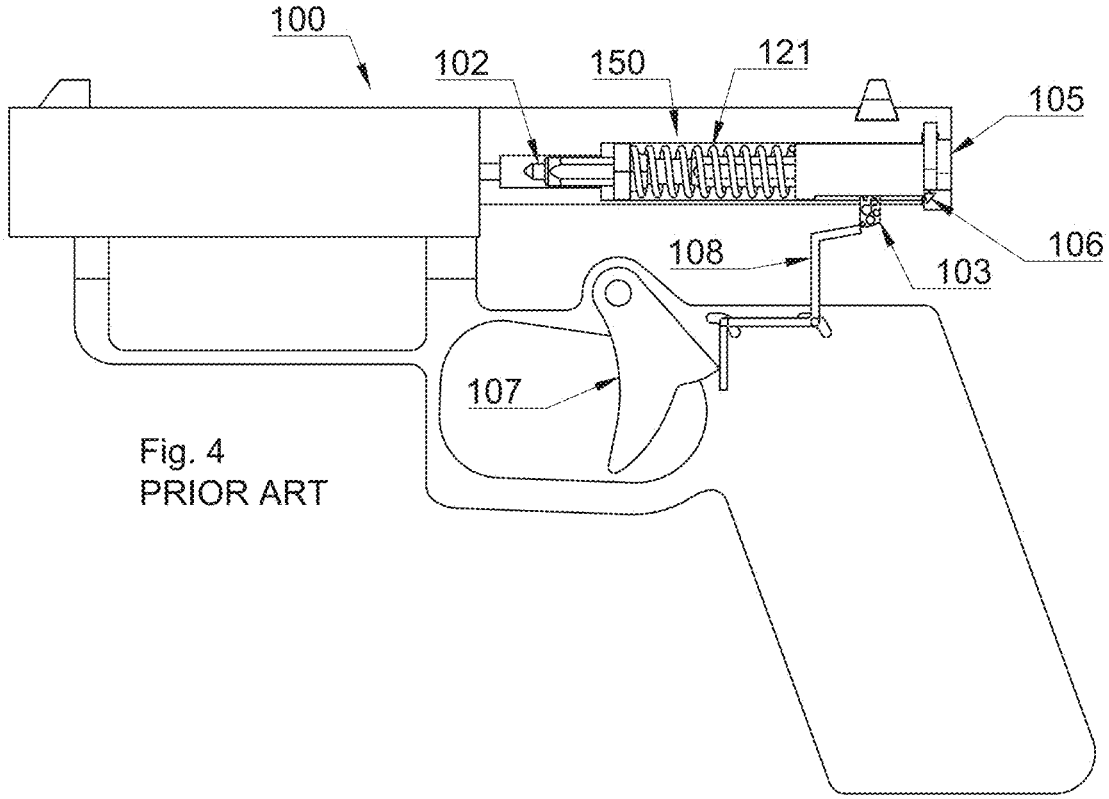
Fig. 4 PRIOR ART
FIG. 4 is a left side view of the Prior Art Slide Firing Pin/Striker System of FIG. 1 in a Disassembly Initiated State showing the trigger partially pulled.

FIG. 4 is a left side view of System 100 of FIG. 1 in a Disassembly Initiated State showing the Trigger 107 partially pulled/actuated. Actuation of Trigger 107 causes trigger bar Sear 108 to displace to the rear (+X Direction) and down (−Y Direction) in a known manner. Top of the trigger bar Sear 108 is at the very bottom of Striker Tang Sear 103 and any further actuation of the Trigger 107 will cause trigger bar Sear 108 to displace further down (in the −Y Direction) and release the Striker 102.

Figure 5:
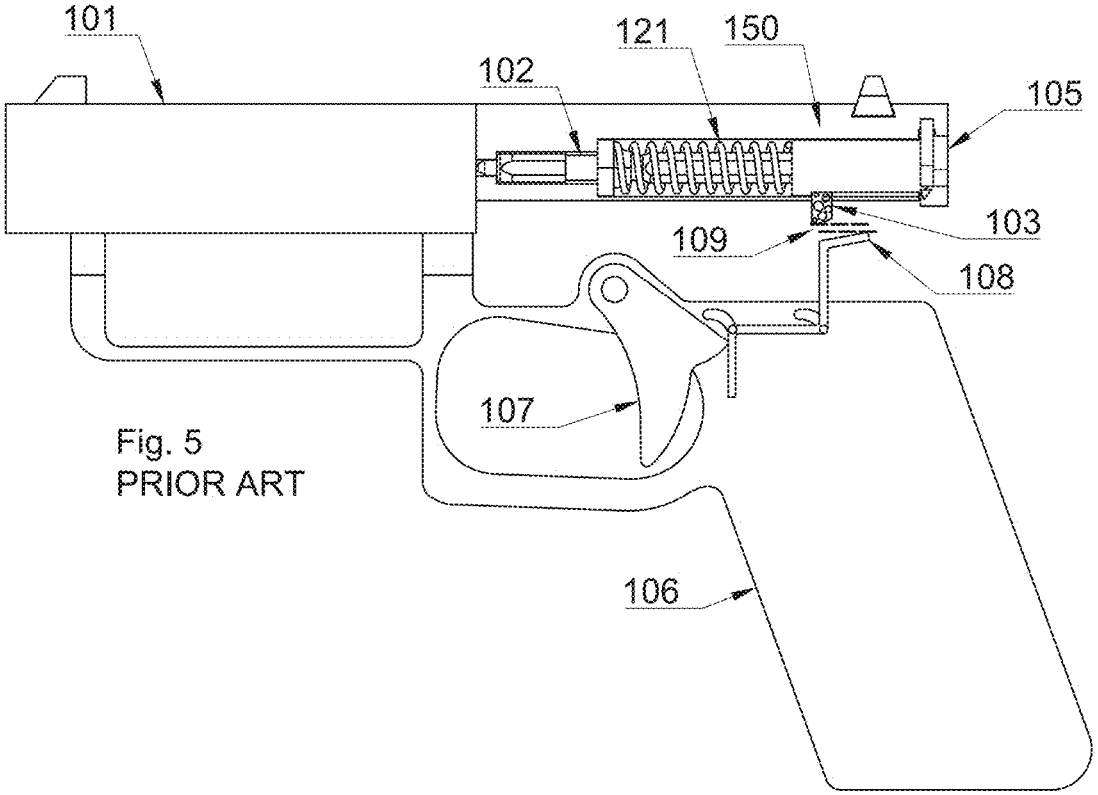
Fig. 5 PRIOR ART
FIG. 5 is a left side view of the Prior Art Slide Firing Pin/Striker System of FIG. 1 with the trigger fully pulled.

FIG. 5 is a left side view of System 100 of FIG. 1 with the Trigger 107 fully pulled. The fully displaced (rearward and downward) trigger bar Sear 108 releases Striker 102 (under the biasing force of Spring 121) and creates a Disassembly Clearance 109 between Striker Tang Sear 103 and trigger bar Sear 108. This action completes the first step of the Disassembly Process.

Only after Disassembly Clearance 109 is created (which allows Striker Tang Sear 103 to translate horizontally over and clear the trigger bar Sear 108) can the firearm be further disassembled. Additional steps and components that must be actuated to unlock Slide 101 and allow it to move forward off Frame 106 are well known and thus not described or illustrated.

Figure 6:
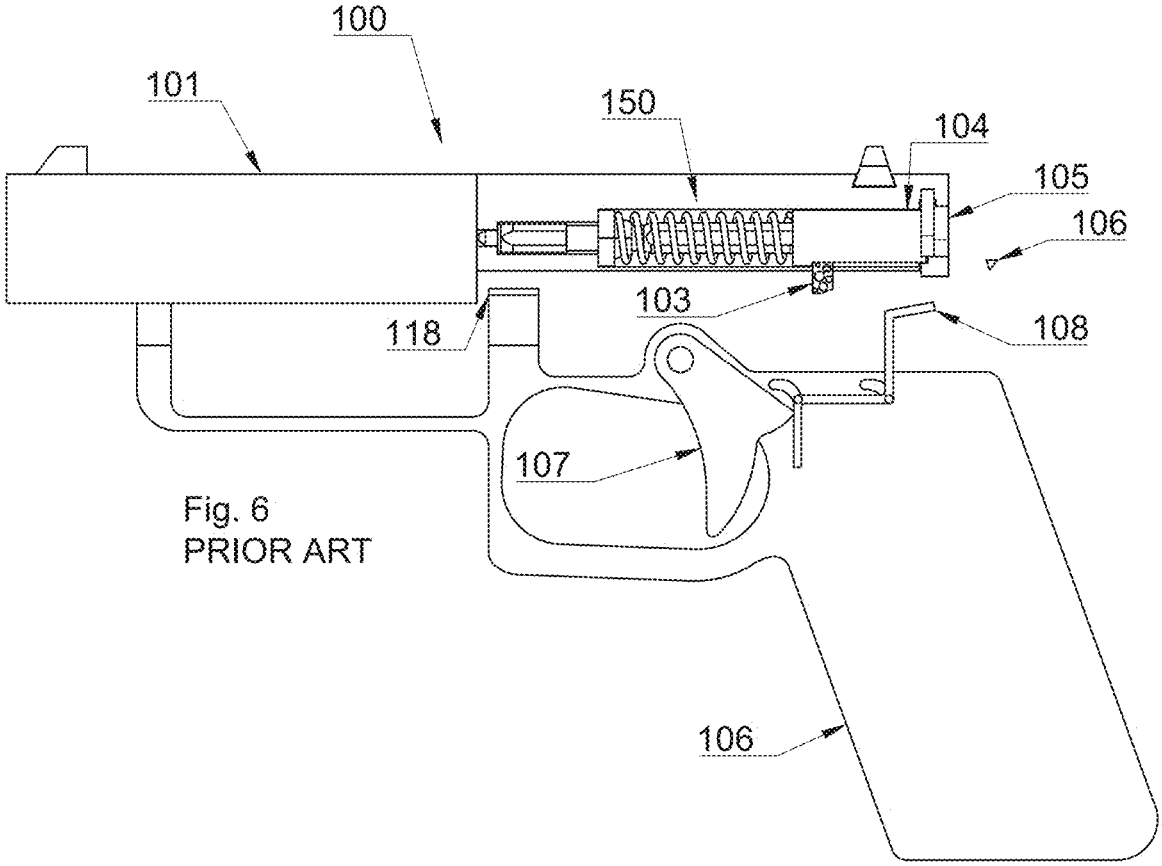
Fig. 6 PRIOR ART
FIG. 6 is a left side view of the Prior Art Slide Firing Pin/Striker System of FIG. 1 in a Mid Disassembly State.

FIG. 6 illustrates how the Slide 101 has been pushed forward along the length of the firearm (−X Direction) in what could be considered a Mid Disassembly State. At this point in the disassembly process, the Striker Tang Sear 103 has cleared the trigger bar Sear 108 and is forward of same.

It is important to reiterate/emphasize that Trigger 107 must be actuated/pulled to create the Disassembly Clearance 109 (which in turn allows further disassembly). As is commonly known and discussed above, actuating the Trigger 107 is also how to fire/discharge the firearm. Thus, the reader will appreciate that requiring the pressing of the Trigger 107 to initiate the disassembly of the firearm carries significant risks. If live ammunition is still chambered in the firearm, a "Negligent/Accidental" discharge of the firearm would occur (which could cause injury or death to the user or others).

It is also worthwhile to note that there are currently more than 50 million firearms utilizing System 100 of FIG. 1. Negligent/Accidental discharges of this type of firearm occur on a weekly (if not almost daily) basis.

Figure 7:
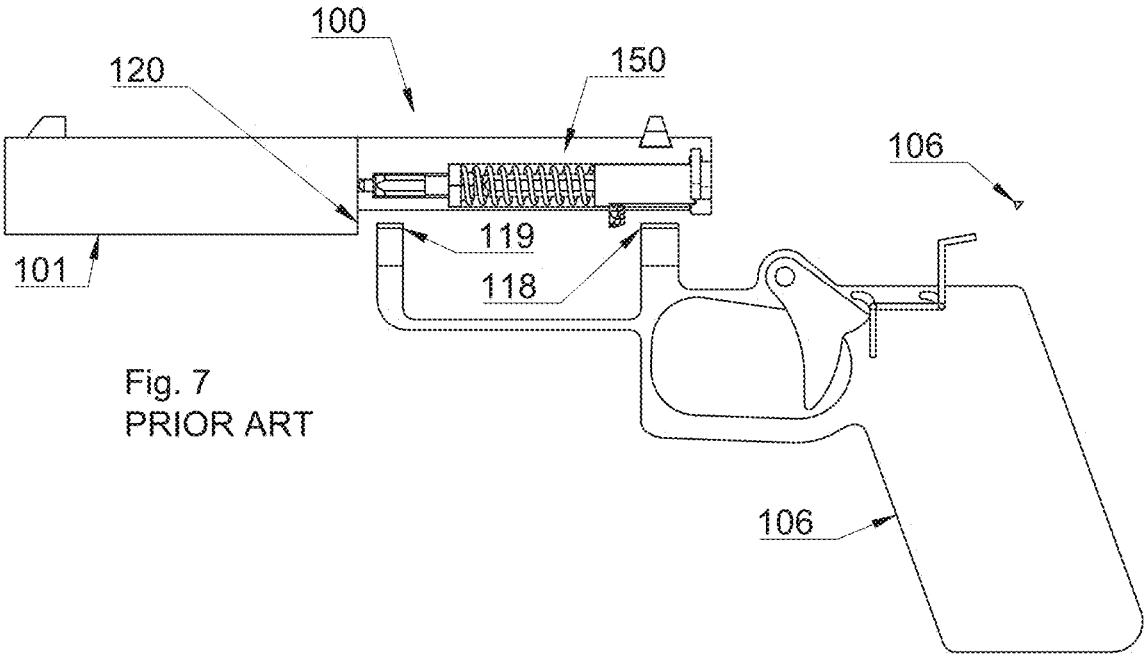
Fig. 7 PRIOR ART
FIG. 7 is a left side view of the Prior Art Slide Firing Pin/Striker System of FIG. 1 in a Fully Disassembled State.

FIG. 7 is a left side view of System 100 of FIGS. 1-3 in a Fully Disassembled State where Slide 101 has been displaced forward enough to clear both Front and Aft Frame Rails (119/118). At this point, Slide 101 can be separated from the Frame 106 of the firearm for cleaning, repairs, storage, etc.

Figure 8:
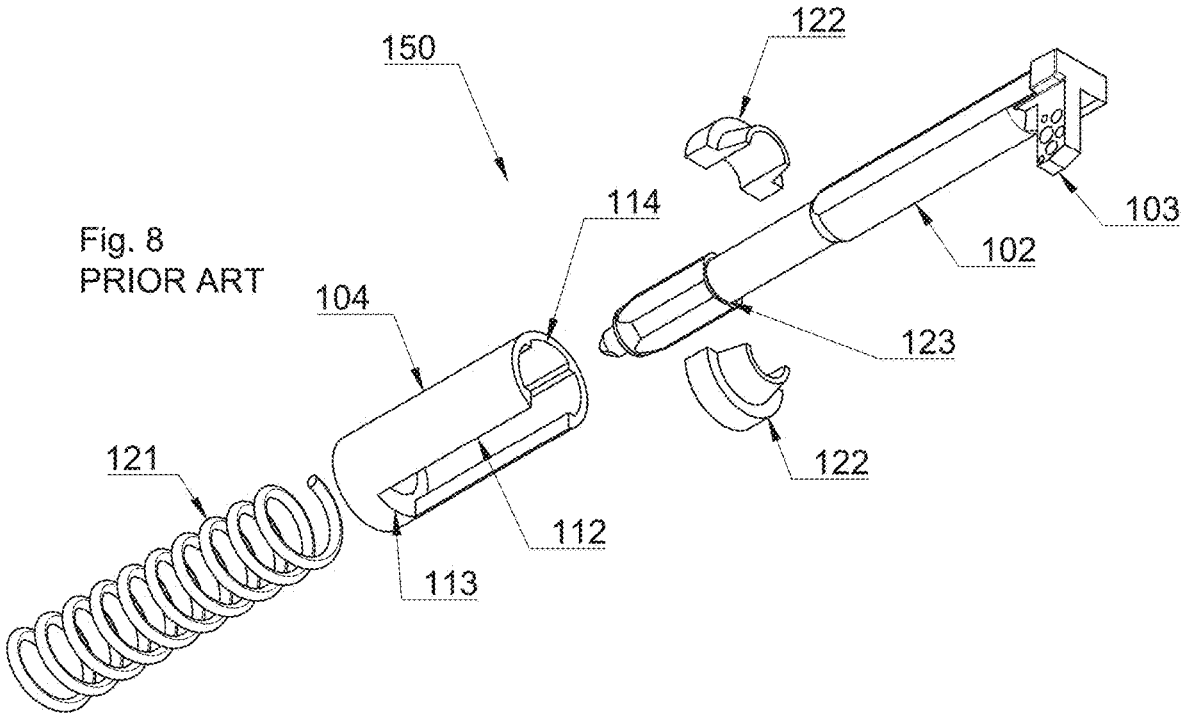
Fig. 8 PRIOR ART
FIG. 8 is a rear-left-bottom exploded isometric view of the components of a Firing Pin/Striker Assembly.

FIG. 8 is a rear-left-bottom exploded isometric view of the components of a Firing Pin/Striker Assembly 150. The Firing Pin/Striker Assembly 150 includes a Striker 102, two Half Clam Spring Capture Cups 122, Striker Sleeve 104 and Spring 121.

Striker 102 further comprises a Striker Tang Sear 103 and Half Clam Spring Capture Cup Edge 123.

Striker Sleeve 104 further comprises a Striker Rotation Edge 112, Bridge 113 and Keyed Lock Interface 114.

Figure 9:
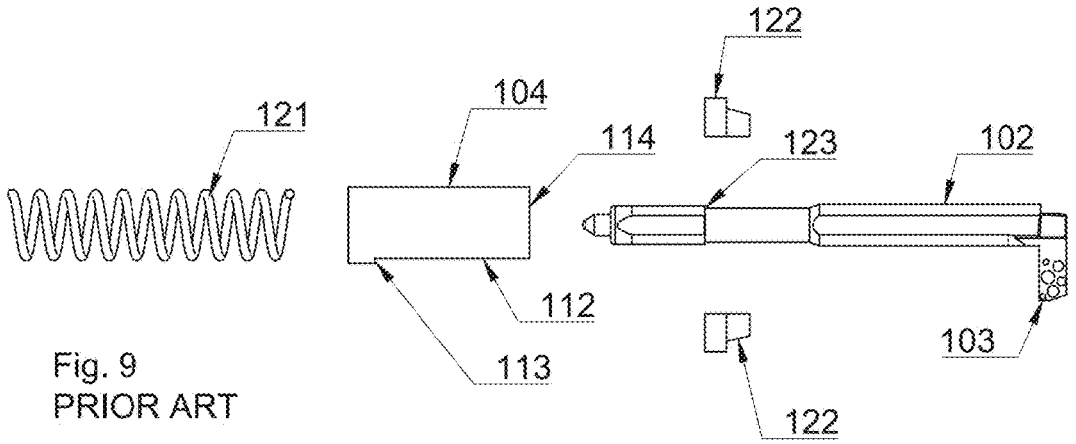
Fig. 9 PRIOR ART
FIG. 9 is a left side view of FIG. 8.

FIG. 9 is a left side view of FIG. 8.

Figure 10:
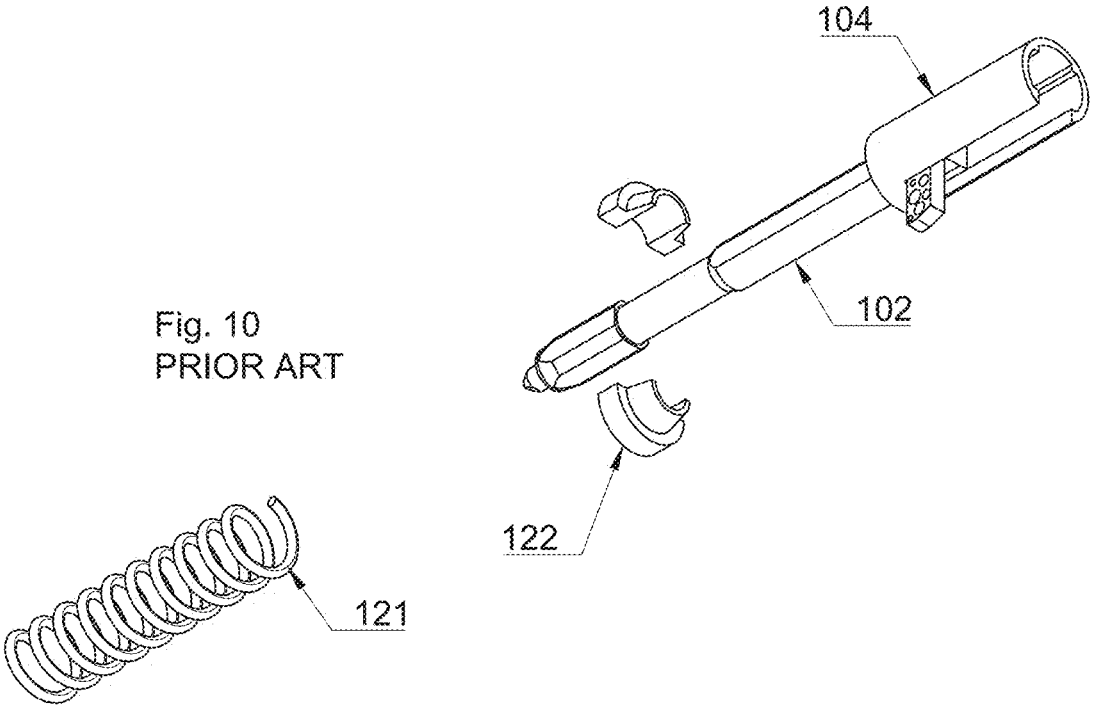
Fig. 10 PRIOR ART
FIG. 10 is a rear-left-bottom exploded isometric view of the components of FIG. 8 after a first step of reassembly.
Figure 11:
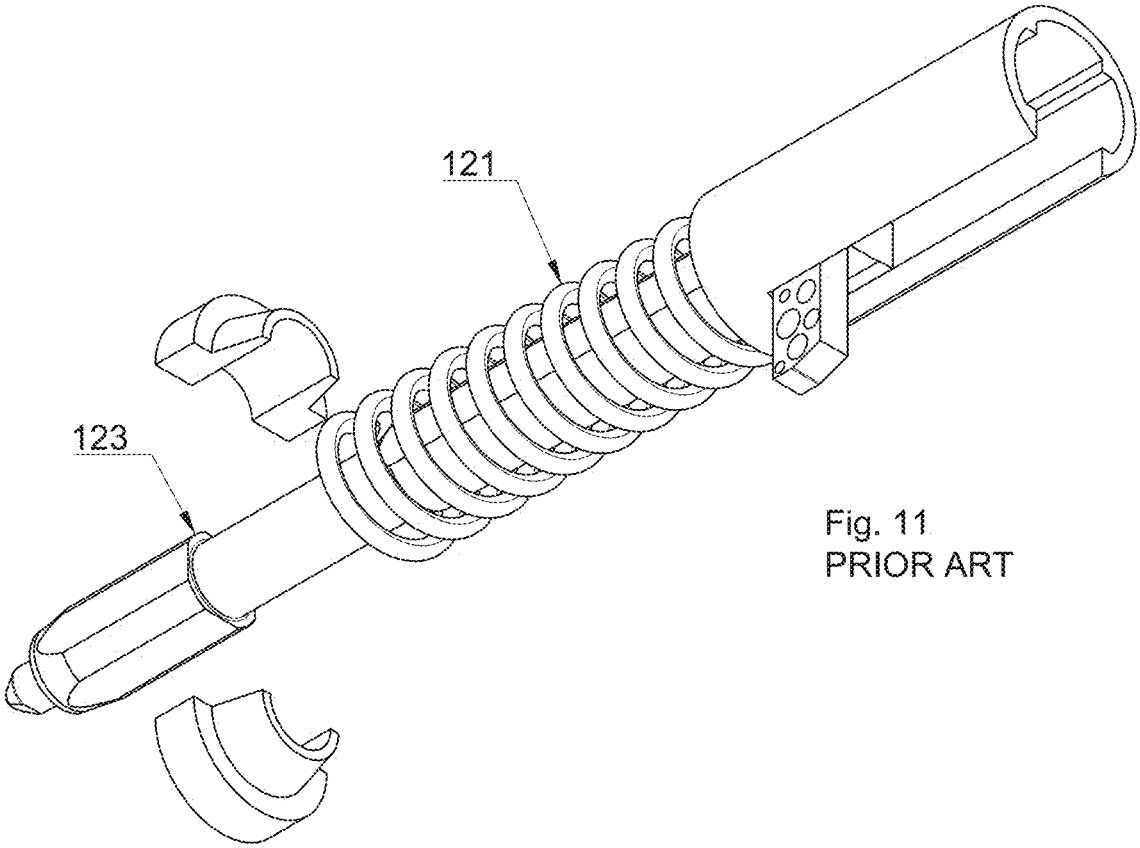
Fig. 11 PRIOR ART
FIG. 11 is a rear-left-bottom exploded isometric view of the components of FIG. 8 after a subsequent step of reassembly from the state of FIG. 10.
Figure 12:
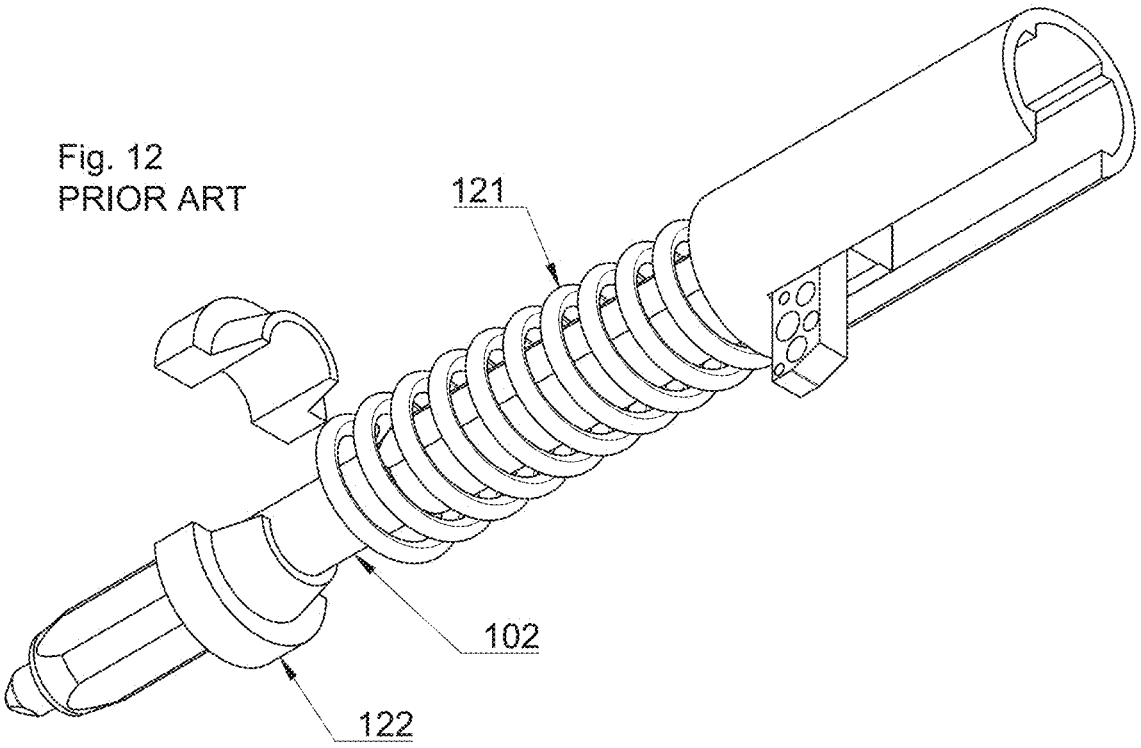
Fig. 12 PRIOR ART
FIG. 12 is a rear-left-bottom exploded isometric view of the components of FIG. 8 after a subsequent step of reassembly from the state of FIG. 11.
Figure 13:
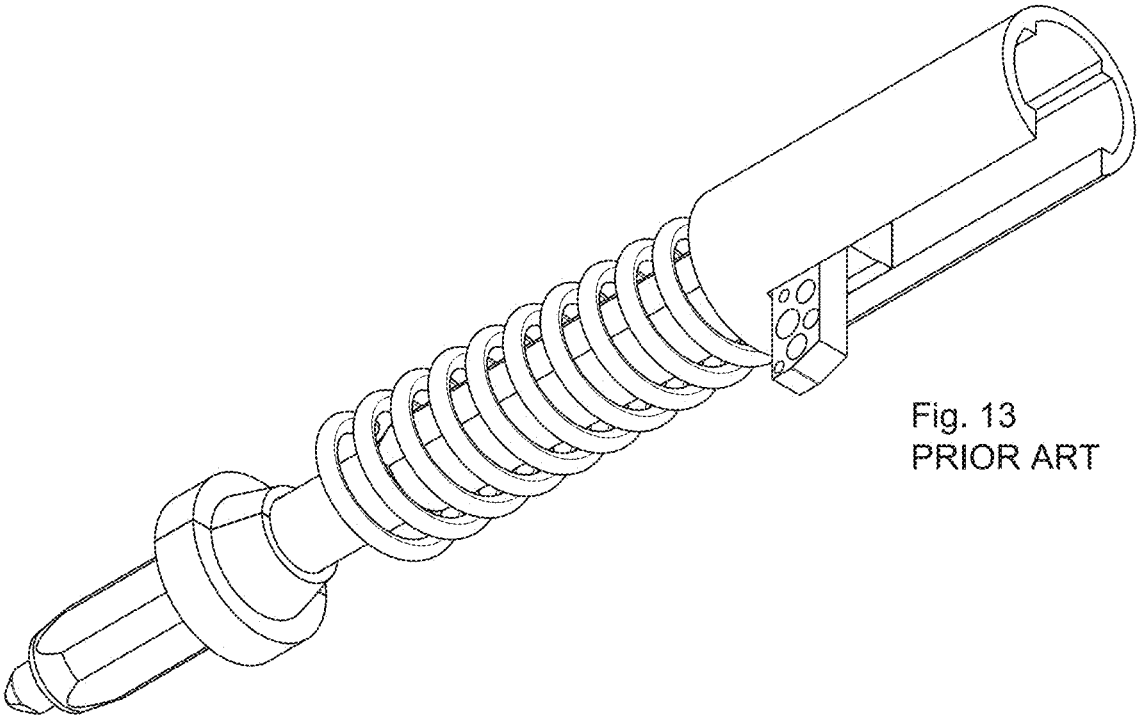
Fig. 13 PRIOR ART
FIG. 13 is a rear-left-bottom exploded isometric view of the components of FIG. 8 after a subsequent step of reassembly from the state of FIG. 12.
Figure 14:
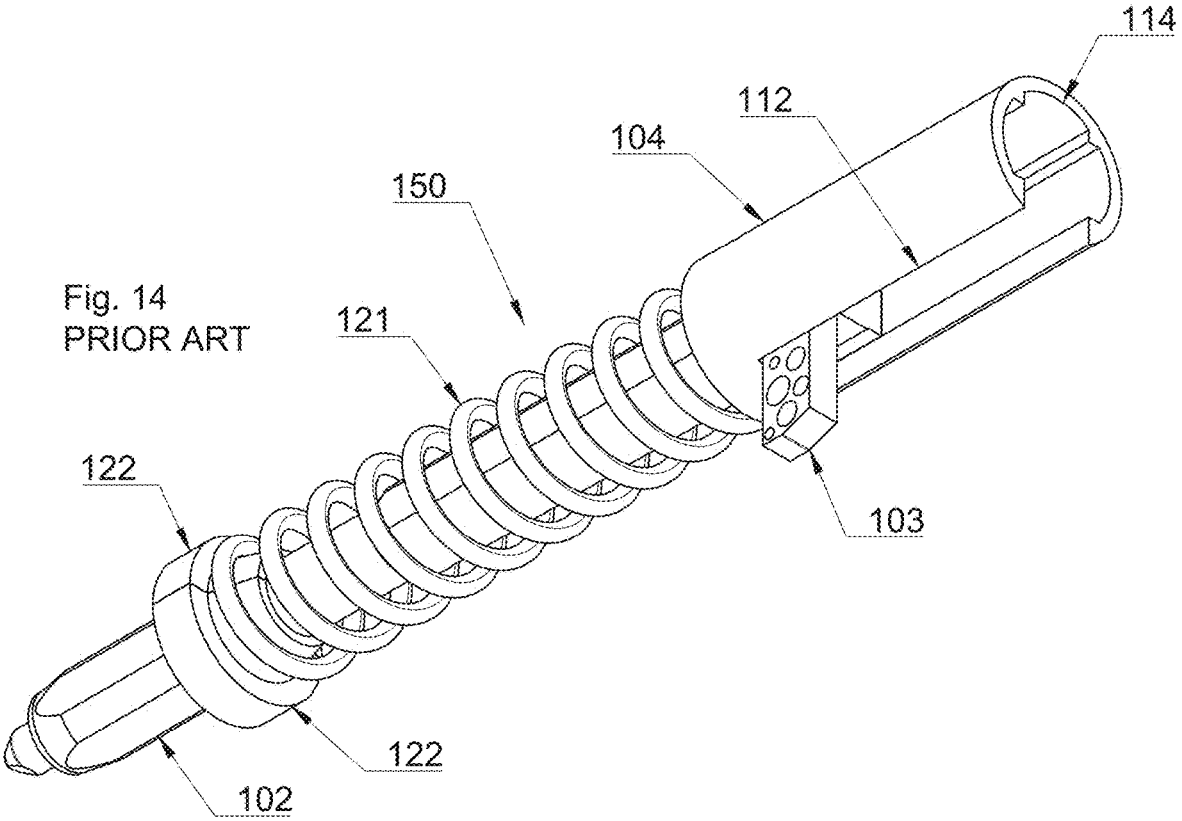
Fig. 14 PRIOR ART
FIG. 14 is a rear-left-bottom isometric view of a fully assembled Firing Pin/Striker Assembly (of the components of FIG. 8) after a final step of reassembly from the state of FIG. 13.

FIGS. 10 through 14 show the step-by-step assembly process of the components of the Striker Assembly 150. Striker Sleeve 104 is slid onto Striker 102 (FIG. 10). Spring 121 is then slid over Striker 102 and compressed (FIG. 11). Both Half Clam Spring Capture Cups 122 are placed around the central shaft of the Striker 102 near its Half Clam Spring Capture Cup Edge 123 (FIGS. 12/13). Spring 121 is then released to capture the two Half Clam Spring Capture Cups 122 against the Half Clam Spring Capture Cup Edge 123 (FIGS. 14/15).

Figure 15:
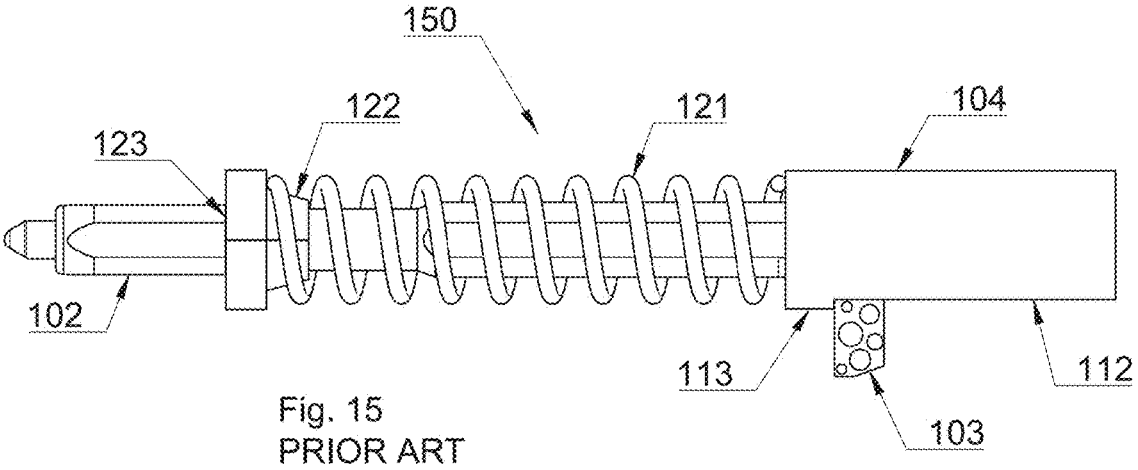
Fig. 15 PRIOR ART
FIG. 15 is a left side view of FIG. 14.
Figure 16:
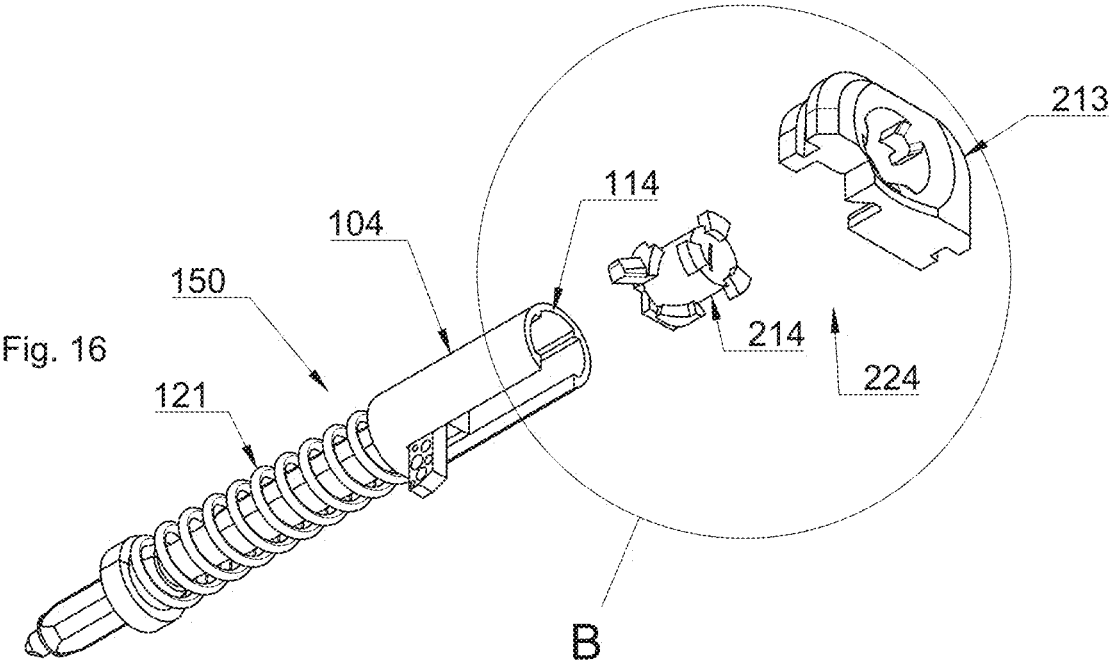
FIG. 16 is a rear-left-bottom exploded isometric view of the components of a Rotatable Lock and Backplate Assembly, according to embodiments of the inventive subject matter.

FIG. 15 is a left side view of the fully assembled Striker Assembly 150.

It is important to note that the prior art was configured to allow only transitional (i.e.—fore/aft along the X axis) movement of the components of the Striker Assembly 150. In addition to the transitional movement (of the prior art), the inventive subject matter allows for rotational (i.e.—rotating/twisting about the central axis) movement of the Striker Assembly 150, as will be described in further detail herein.

It should be easy to envisage that rotating/twisting of Striker Sleeve 104 about its axis would likewise rotate/twist Striker Tang Sear 103 due to its interplay with Striker Rotation Edge 112.

FIGS. 16 through 19 are various exploded isometric views of the components of a Rotatable Lock and Backplate Assembly 224, according to embodiments of the inventive subject matter. A Rotatable Lock 214 and Backplate 213 comprise the components of the Rotatable Lock and Backplate Assembly 224.

Rotatable Lock 214 further comprises three (situated at 120 degrees intervals around its body) Locking Peaks 216, three Thumb Interface Nubs 222, Keyed Sleeve Interface 218 and Unlocking Prevention/Displacement Limiter 220.

Backplate 213 further comprises three (situated at 120 degrees intervals) Locking Peak Divots 215 around its central hollow cylinder and Displacement Limiter Interface 223.

When assembled in the "Locked/Operational" State, the three Locking Peaks 216 communicate with the three Locking Peak Divots 215. Keyed Sleeve Interface 218 communicates with Keyed Lock Interface 114 (of Striker Sleeve 104) and rotationally locks Rotatable Lock 214 to Striker Assembly 150.

When Striker Assembly 150 is assembled into either (prior art or inventive subject matter) system, the systems are configured to preload the Spring 121 (in a known manner and for a known purpose) so as to affect a gap between the front edge of Striker Tang Sear 103 and Bridge 113 (of Striker Sleeve 104) as illustrated in FIGS. 1 and 2. This preloading/compressing of Spring 121 transfers the spring force to bias the three Locking Peaks 216 (of Rotatable Lock 214) into the "valleys" of the three Locking Peak Divots 215 thus locking the Rotatable Lock 214 and Striker Assembly 150 into the Locked/Operational State.

Figure 20:
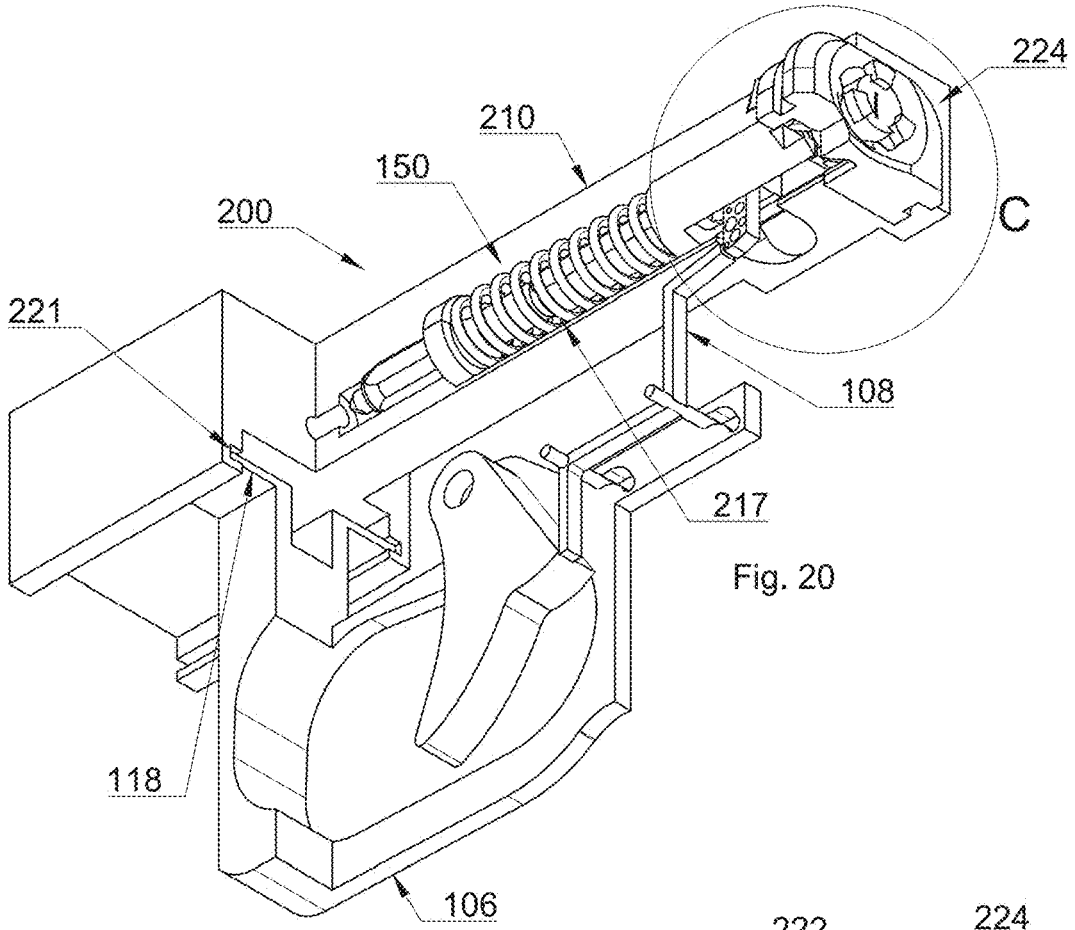
FIG. 20 is a rear-left-bottom isometric view of a Backward Compatible Safety Slide Firing Pin/Striker System in a Pre Disassembly Initiated State, according to embodiments of the inventive subject matter.
Figure 21:
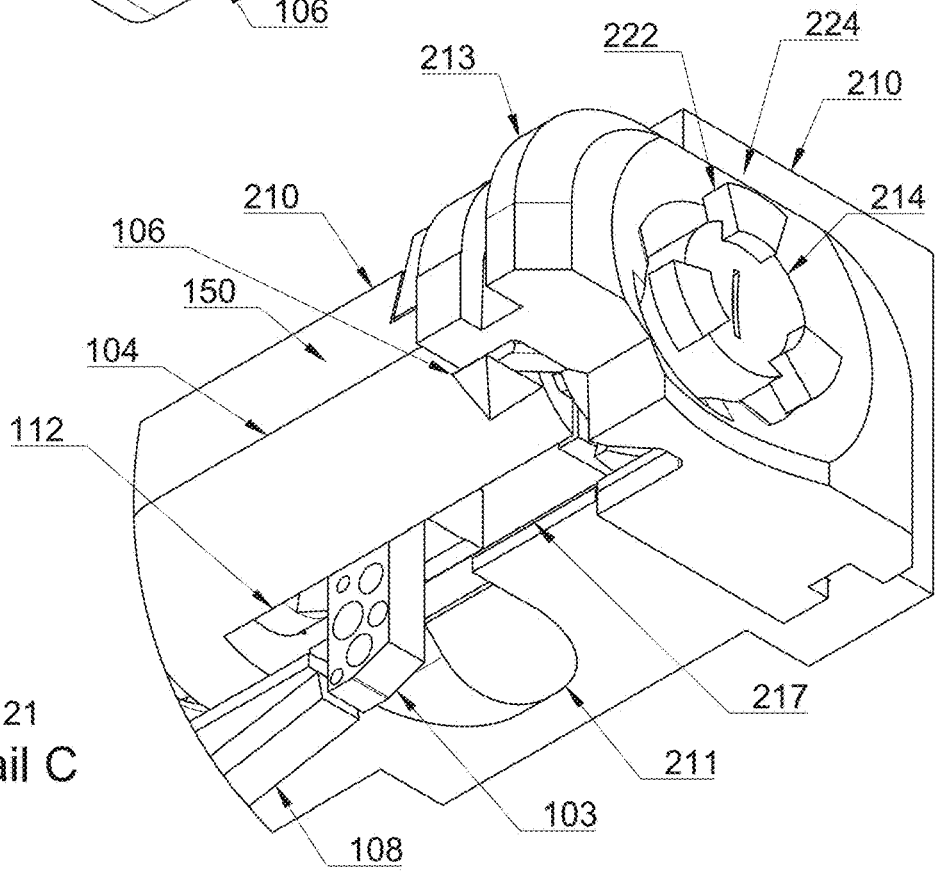
FIG. 21 is a detailed view of Section C of FIG. 20.
Figure 23:
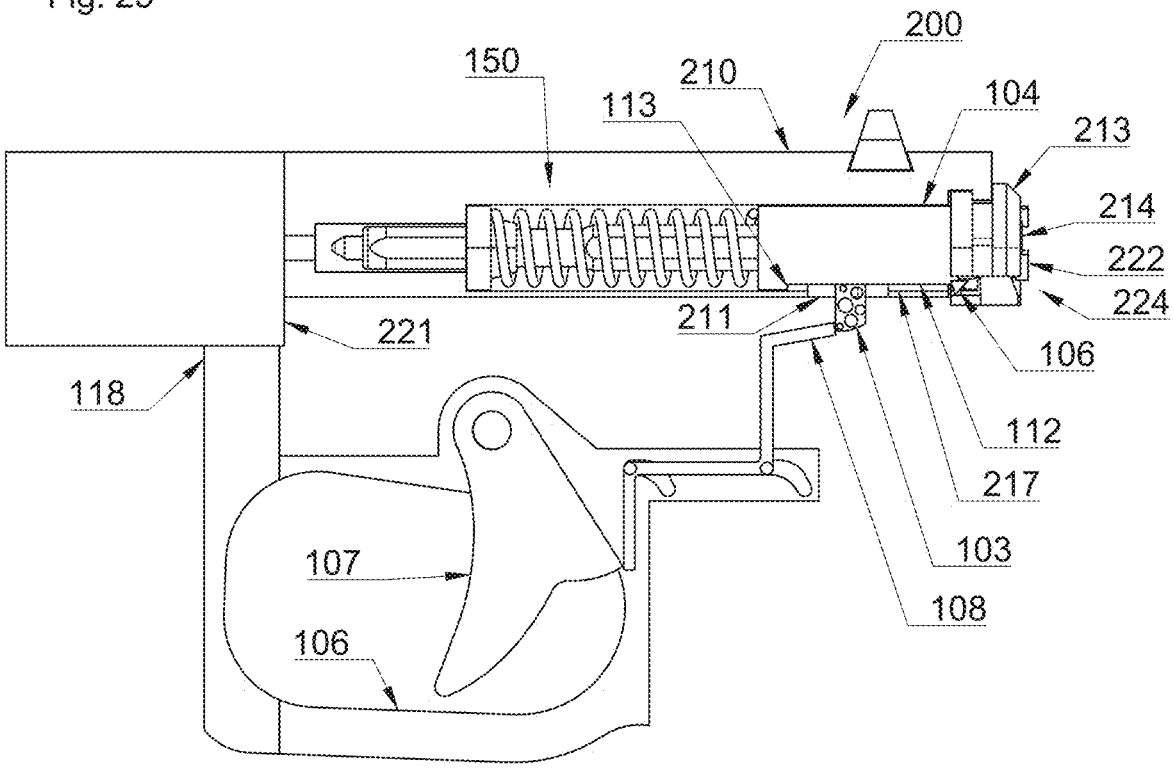
FIG. 23 is a left side view of FIG. 20.

FIGS. 20, 21 and 23 correspond to the Pre Disassembly Initiated State of a Backward Compatible Safety Slide Firing Pin/Striker System 200 (hereinafter "System 200"), according to embodiments of the inventive subject matter.

As with the prior art depictions of FIGS. 1-3, the state of FIGS. 20, 21 and 23 would also correspond to the state of normal use/operation of the firearm—to discharge ammunition via actuation of the trigger.

FIG. 20 is a rear-left-bottom isometric view of System 200, comprising a Backward Compatible Safety Slide 210 (hereinafter "Slide 210"), Striker Assembly 150, and Rotatable Lock and Backplate Assembly 224.

Figure 22:
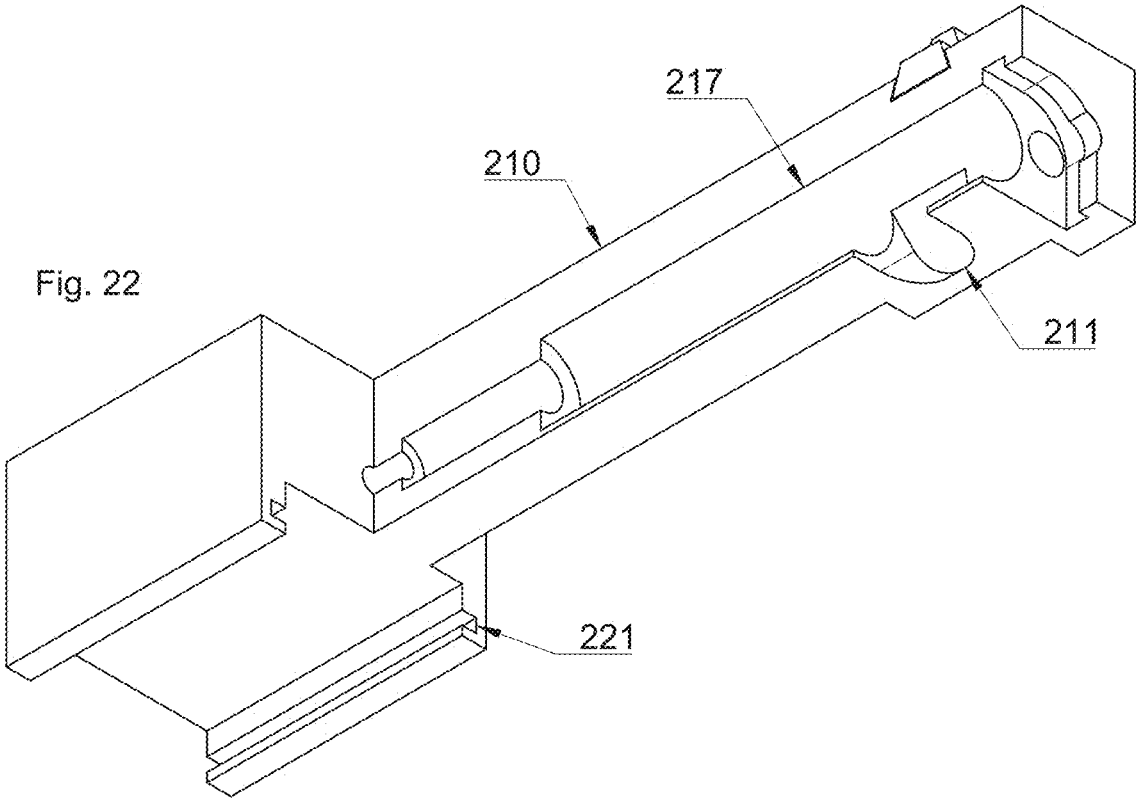
FIG. 22 is a rear-left-bottom isometric view of a Backward Compatible Safety Slide in isolation, according to embodiments of the inventive subject matter.

FIG. 22 is a rear-left-bottom isometric view of Slide 210 from FIGS. 20-21, shown in isolation, according to embodiments of the inventive subject matter. Slide 210 includes Striker Tang Sear Divot 211 (hereinafter "Divot 211"), Backward Compatible Safety Slide Striker Channel 217 (hereinafter "Channel 217") and Backward Compatible Safety Slide Rail Grooves 221 (hereinafter "Grooves 221").

As seen in FIGS. 20-23, Channel 217 is dimensioned to receive Striker Assembly 150 for normal operation of the firearm and also for the disassembly procedure of the inventive subject matter discussed in greater detail herein. Divot 211 is dimensioned to at least partially receive Striker Tang Sear 103 when the Striker Assembly 150 within Channel 217 is rotated as is discussed in further detail herein.

Grooves 221 serve to mate with the Frame Rails 118 and 119 of the Frame 106 to secure the System 200 and allow the appropriate movements during normal operation of the firearm and for assembly/disassembly as discussed herein.

FIG. 21 is a detailed view of Section C of FIG. 20 showing the positional relationships of trigger bar Sear 108, Striker Tang Sear 103, Striker Sleeve 104, Striker Rotation Edge 112, Divot 211, Rotatable Lock 214 and Backplate 213.

FIG. 23 is a left side view of FIG. 20.

FIGS. 20, 21 and 23 also illustrate the communication between Striker Assembly 150 and Rotatable Lock and Backplate Assembly 224 in the Locked/Operational State. Striker Tang Sear 103 is in contact with the trigger bar Sear 108 of Frame 106. Thus, actuation of the Trigger 107 would cause trigger bar Sear 108 to interact with the Striker Tang Sear 103. If ammunition was in the firearm with a round chambered, this would cause the firearm to discharge.

An important note considering the Unlocking Prevention/Displacement Limiter 220 (FIGS. 17 and 19) is addressed herein.

If not for the Unlocking Prevention/Displacement Limiter 220 (FIGS. 17 and 19), System 200 could transition to an "Unlocked/Disassembly" State (rendering the firearm inert) should the firearm be roughly handled (e.g.—when an assailant attempts to wrestle away a police officer's firearm). In other words, due to the Limiter's design, no external force can cause System 200 to transition to the Unlocked/Disassembly State from the Locked/Operational State other than actuation via the rotatable lock 214.

Figure 24:
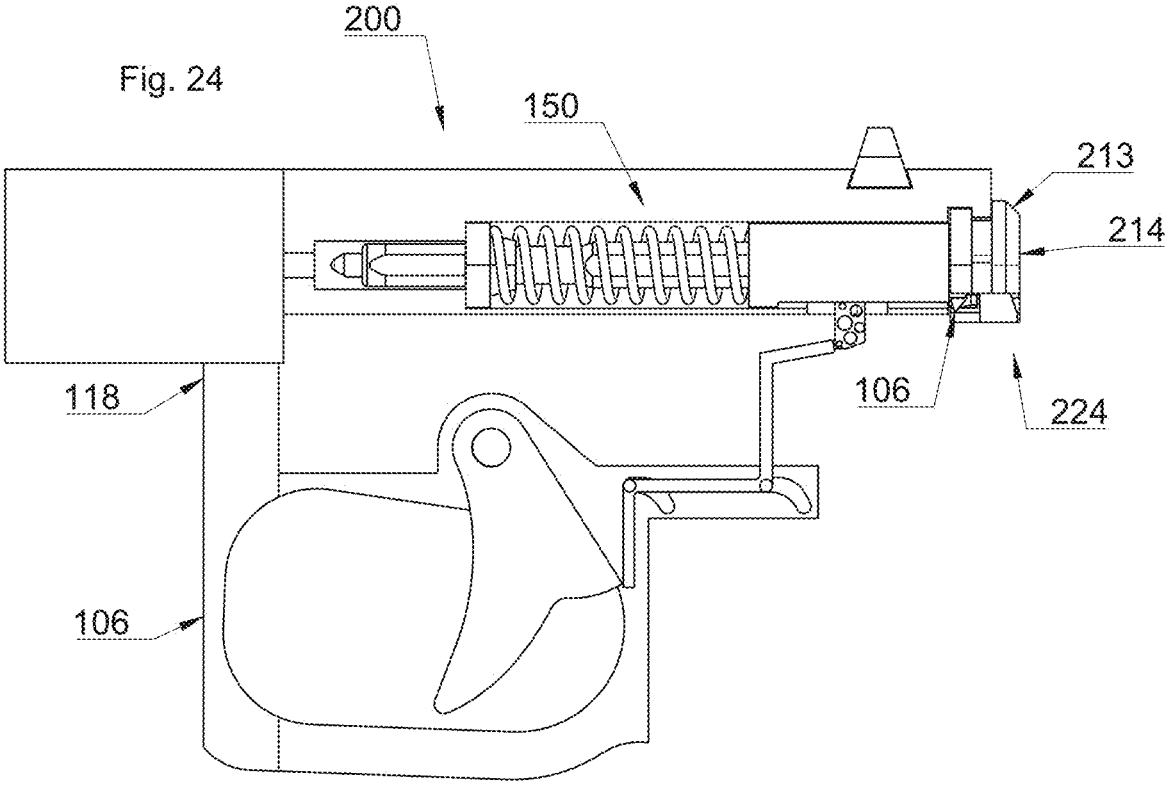
FIG. 24 is a left side view of the Backward Compatible Safety Slide Firing Pin/Striker System of FIG. 20 when an undesirable unlocking is attempted, according to embodiments of the inventive subject matter.

FIG. 24 is a left side view of System 200 when an undesirable unlocking is attempted, according to embodiments of the inventive subject matter.

Figure 25:
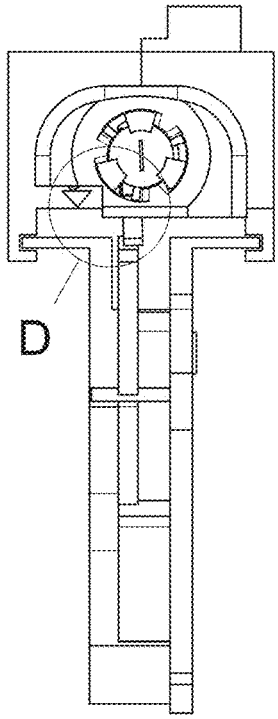
FIG. 25 is a rear side view of FIG. 24.

FIG. 25 is a rear side view of FIG. 24.

Figure 17:
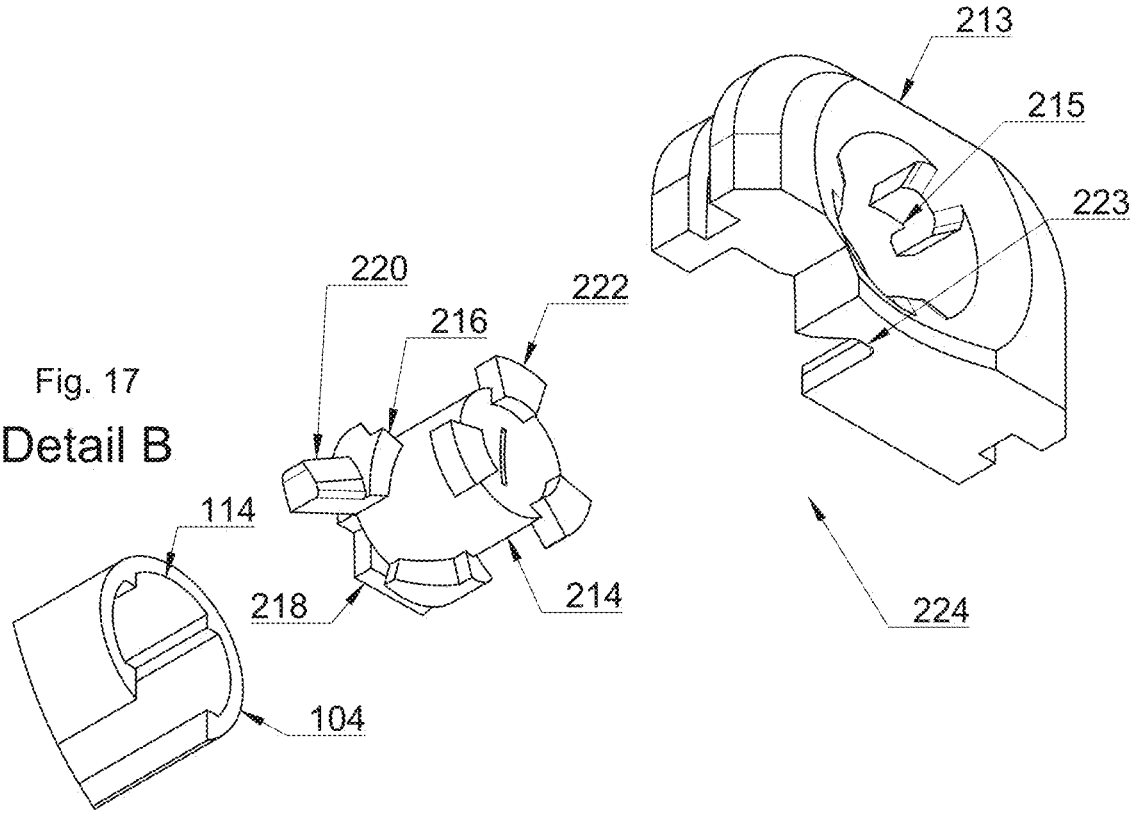
FIG. 17 is a detailed view of Section B of FIG. 16.

As illustrated in the detailed view of FIG. 17, the Unlocking Prevention/Displacement Limiter 220 is configured like an arm that sticks out of the piston-like body of the Rotatable Lock 214. Simply put, the end of the arm is configured to interfere with Frame 106 to prevent unlocking from the Locked/Operational State.

Figure 26:
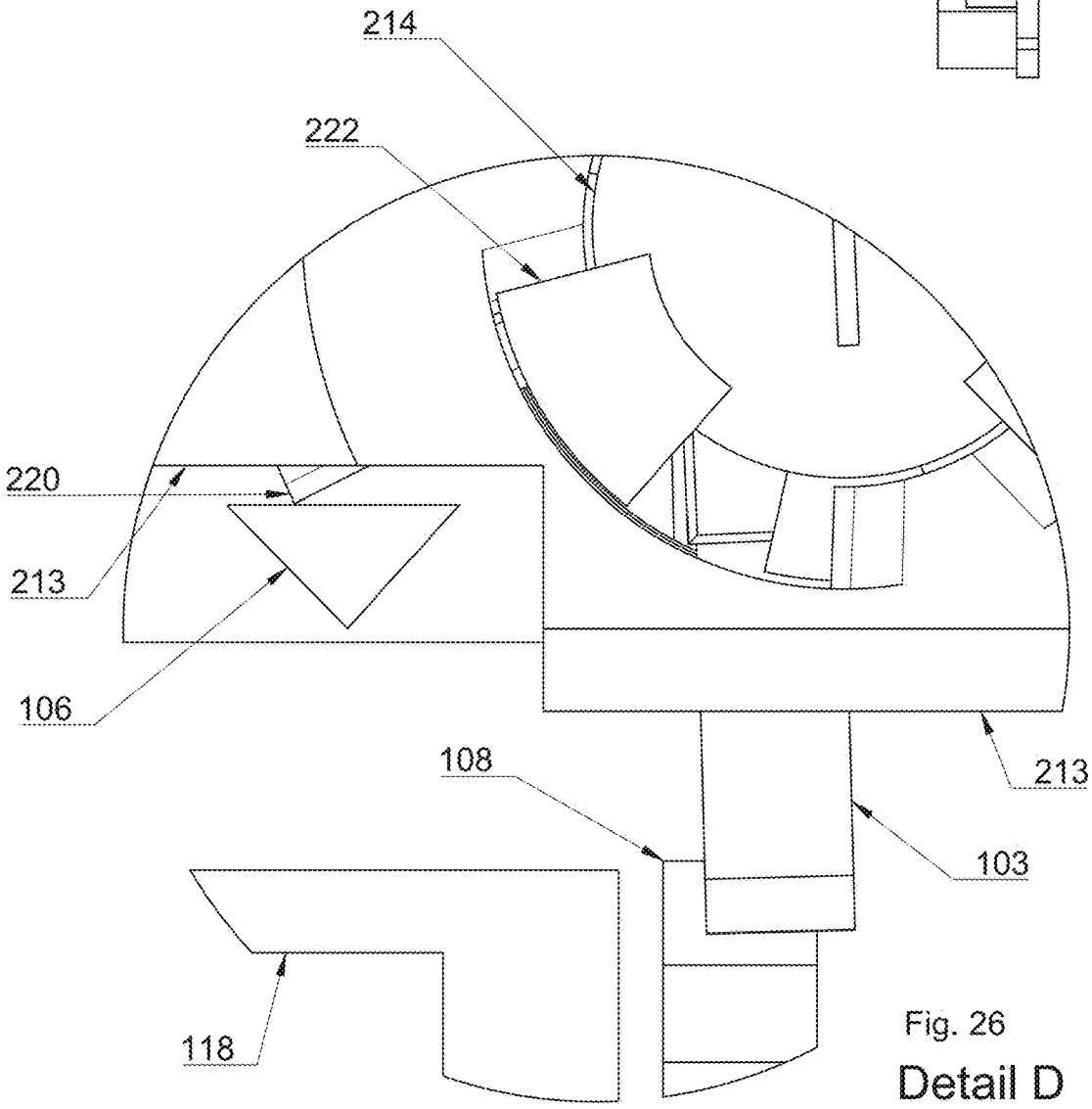
FIG. 26 is a detailed view of Section D of FIG. 25.

FIG. 26 is a detailed view of Section D of FIG. 25 illustrating the aforementioned interference of the Unlocking Prevention/Displacement Limiter 220 against the Frame (illustrated here as an upside down pyramid) 106. In preferred embodiments, this interference occurs at 2 degrees or less out-of-vertical for the rotationally locked components of Striker Tang Sear 103 and Rotatable Lock 214. The tip of Unlocking Prevention/Displacement Limiter 220 is shown abutted against the base of upside down pyramid portion of Frame 106 and Striker Tang Sear 103 is approximately 2 degrees out of vertical (but still in communication with trigger bar Sear 108).

Figure 27:
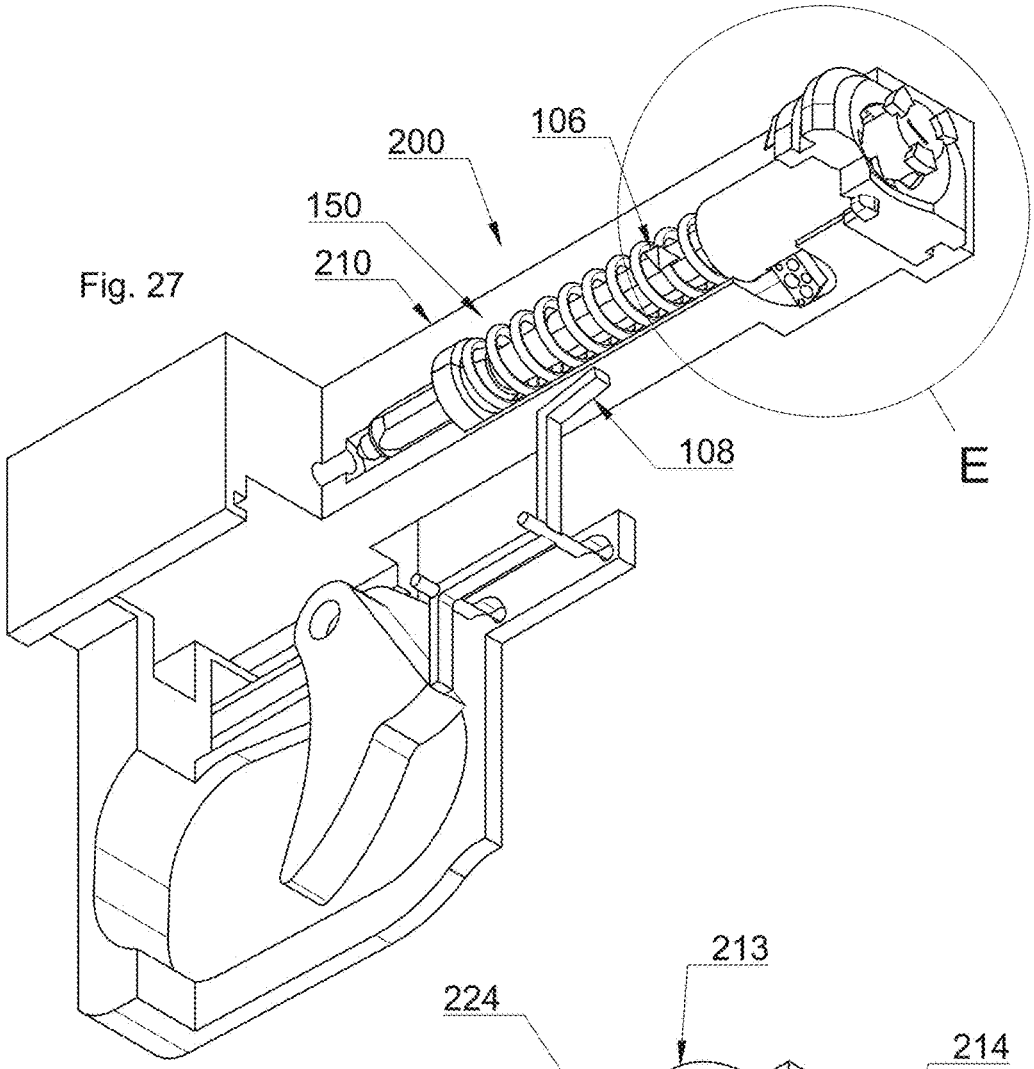
FIG. 27 is a rear-left-bottom isometric view of the Backward Compatible Safety Slide Firing Pin/Striker System of FIG. 20 in a Disassembly Initiated State.

FIG. 27 is a rear-left-bottom isometric view of the System 200 of FIGS. 20-23, in the Disassembly Initiated State, according to embodiments of the inventive subject matter. The first step in the disassembly process is to manipulate Slide 210 to its rearmost travel limit and lock it in the "Open Action" State.

The Open Action State is a well known state where the slide of a firearm is locked back/open (by other known operations and components) to unload, clear malfunctions, or facilitate reloading.

The Open Action State displaces the Unlocking Prevention/Displacement Limiter 220 (of the Rotatable Lock 214) away from the Frame 106 (to preclude Limiter interference). As a point of clarification/reiteration, System 200 can only be Unlocked or Locked in the Open Action State.

System 200 is transitioned to the Unlocked/Disassembly State (with reference to FIGS. 21 and 17) by pushing/displacing Rotatable Lock 214 (via the Thumb Interface Nubs 222 and against the biasing force of the Spring 121 of the Striker Assembly 150) sufficiently enough so that its three Locking Peaks 216 (which were previously communicating with the "valleys" of the three Locking Peak Divots 215) clears the "hills" of the three Locking Peak Divots 215 as Rotatable Lock 214 is subsequently rotated counterclockwise (in the shown example, approximately 60 degrees). This rotation aligns its three Locking Peak 216 bodies with the correspondingly configured semi circular grooves (formed between the three Locking Peak Divots 215) within the central hollow cylindrical opening of Backplate 213.

The rotation/twisting of the Rotatable Lock 214 causes the rotationally locked Striker Tang Sear 103 to rotate/"tuck" wholly or partially into the properly configured and aligned Divot 211 of Slide 210.

The amount that Striker Tang Sear 103 moves into Divot 211 can be dictated by factors such as the size of the Striker Tang Sear 103 and the relative width of Slide 210. However, it should be understood that the movement of Striker Tang Sear 103 into Divot 211 is sufficient for the Striker Tang Sear 103 to clear the trigger bar Sear 108 as discussed herein.

Figure 28:
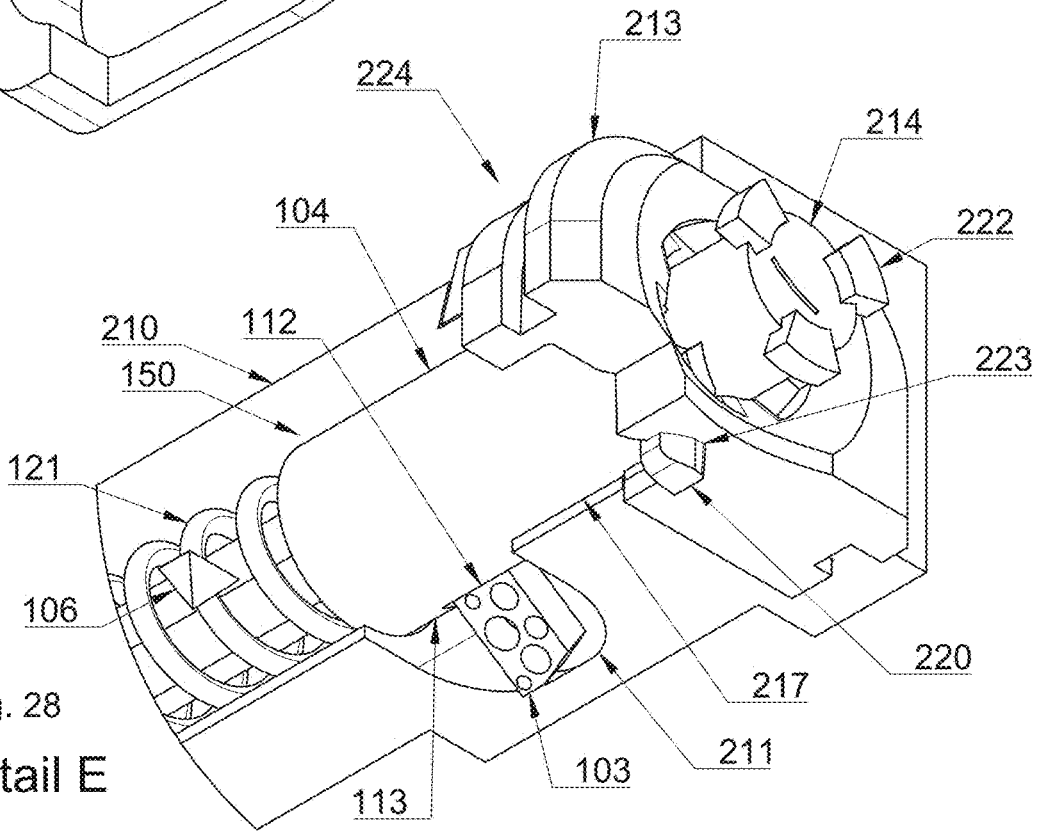
FIG. 28 is a detailed view of Section E of FIG. 27.

As illustrated in the detailed view of FIG. 28, subsequently releasing thumb pressure from the three Thumb Interface Nubs 222 allows force of Spring 121 to displace the Striker Sleeve 104 and Rotatable Lock 214 rearward to remove the previously described (at the end of descriptions of FIGS. 16-19) gap between the front edge of Striker Tang Sear 103 and Bridge 113 (of Striker Sleeve 104) while simultaneously abutting the appropriately configured Unlocking Prevention/Displacement Limiter 220 (of Rotatable Lock 214) against Displacement Limiter Interface 223 (of Backplate 213). Interference between Unlocking Prevention/Displacement Limiter 220 and Displacement Limiter Interface 223 contains Striker Assembly 150 within Slide 210.

Displacement of Rotatable Lock 214 into Backplate 213 also slides the bodies of the three Locking Peaks 216 (referencing FIG. 17) into the correspondingly configured semi circular grooves (formed between the three Locking Peak Divots 215) within the central hollow cylindrical opening of the Backplate 213. This rotationally locks the Striker Assembly 150 (and thus its Striker Tang Sear 103) in the "tucked" position in Divot 211.

Rotatable Lock 214 will stand proud of Backplate 213 at the end of this action to visually inform the user that System 200 is now in the Unlocked/Disassembly State.

Figure 29:
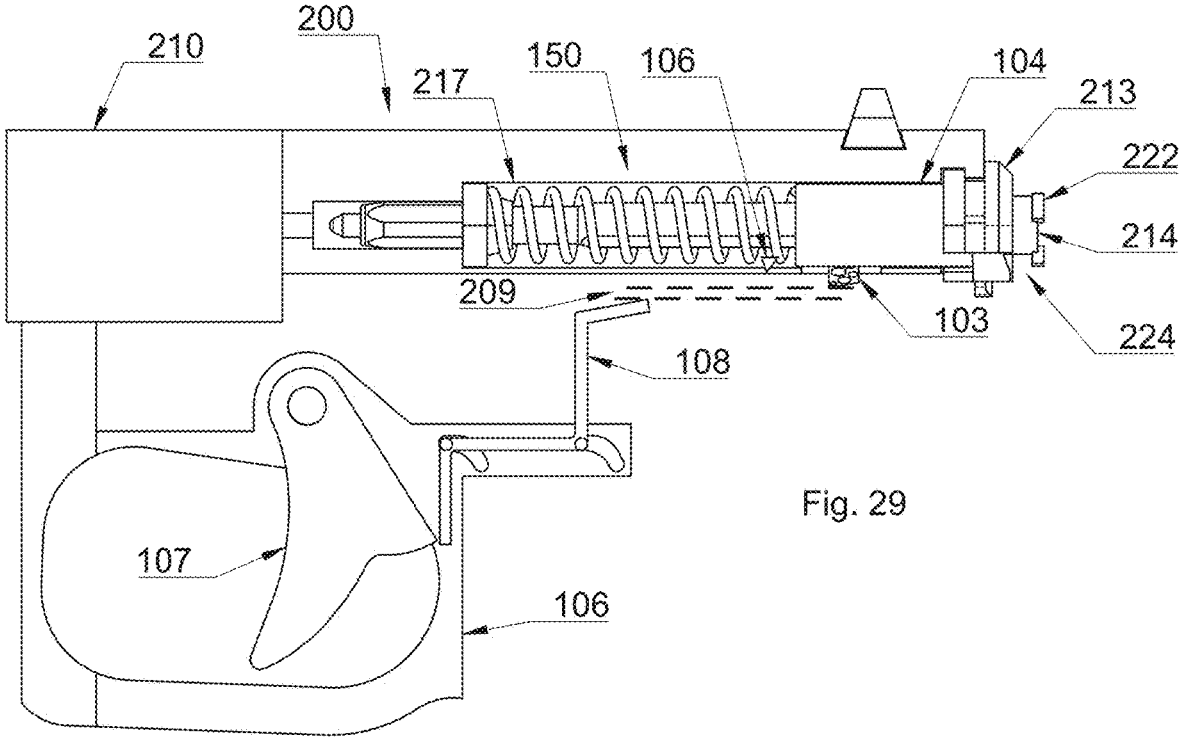
FIG. 29 is a left side view of FIG. 27.

FIG. 29 is is a left side view of FIG. 27. Tucking the Striker Tang Sear 103 into Divot 211 creates a Rotationally Generated Disassembly Clearance 209 between Striker Tang Sear 103 and trigger bar Sear 108.

The Rotationally Generated Disassembly Clearance 209 allows the Striker Tang Sear 103 to translate horizontally over and clear the trigger bar Sear 108 to allow further disassembly without Trigger 107 actuation (as was required by the prior art). This difference is clearly illustrated in the different positions of Triggers 107 in System 100 of FIG. 5 and System 200 of FIG. 29. Additional steps and components that must be actuated to unlock Slide 210 and allow it to move forward off Frame 106 are well known and thus not described or illustrated.

The Rotatable Lock 214 of the described embodiment utilizes three Thumb Interface Nubs 222 as Actuation Elements of System 200. As implied by the name, the Thumb Interface Nubs 222 interface with the user's thumb or finger.

In other embodiments, an Actuation Element of rotatable lock 214 can be in the form of a groove can be dimensioned to be actuated by a common object such as a coin, fingernail, or a flat-head screwdriver.

In alternative embodiments, the Actuation Element of rotatable lock 214 can be a cavity dimensioned and shaped to receive a specific tool such as a hexagonal shaped-tool, a Phillips-head screwdriver, or a custom-shaped tool.

In yet other embodiments, the Actuation Element of rotatable lock 214 can be a tab extending outward from the Lock that the user can grip between two or more fingers.

It should be appreciated that in addition to the safer disassembly methods discussed herein, the systems of the inventive subject matter serve as a safety even when disassembly is not intended. If Slide 210 is moved to its operational/closed position from the State of FIG. 29, the firearm cannot be discharged by pulling the Trigger 107. Pulling the Trigger 107 will actuate the trigger bar Sear 108 but, because the trigger bar Sear 108 is no longer engaged with the Striker Tang Sear 103, the Striker Assembly 150 will not be actuated.

The system 200 could be incorporated into new firearm designs and is also backward compatible by simply utilizing a Prior Art Backplate 105 seen in FIG. 1 instead of Backplate 213 and Rotatable Lock 214 of the present invention. This allows for the Slide 210 to be used within a conventional firearm in a conventional fashion, should the user choose to disable the safety benefits discussed herein. It should be noted that using a conventional Prior Art Backplate 105 would revert the system to requiring trigger actuation for disassembly.

The invention could be manufactured using any industry standard materials (metals, alloys, sheet metal, plastics, etc.) and processes (injection molding, MIM, sheetmetal folding, additive manufacturing/3D printing, subtractive machining, etc.). Alternative embodiments, combinations, and/or uses of the methods and devices described above and obvious modifications and equivalents thereof are intended to be included within the scope of the invention.

Although the described Backward Compatible Safety Slide Firing Pin/Striker System is for a popular brand of firearm, it is not meant to be limited to just that brand or type (i.e.—the invention is applicable to other brands and/or handguns, rifles etc.).

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A system for safely disassembling a firearm, comprising:

a slide having a channel, the channel dimensioned to receive a striker sleeve;

the striker sleeve disposed within the channel and dimensioned to receive a striker;

the striker having a striker tang sear, wherein the striker tang sear is aligned with a trigger bar sear of a frame of the firearm when the striker tang sear is at a first tang sear position; and wherein the slide includes a divot extending laterally from the channel, the divot disposed on the slide such that the divot becomes aligned with the striker tang sear when the slide is at an open action state, and the divot dimensioned to at least partially receive the striker tang sear when the striker tang sear is moved to a second tang sear position.

2. The system of claim 1, further comprising a backplate, the backplate further comprising a rotatable lock that is coupled with the striker sleeve such that movement of the rotatable lock causes the striker sleeve to rotate between the first tang sear position and the second tang sear position.

3. The system of claim 2, wherein the rotatable lock further comprises an actuation element.

4. The system of claim 3, wherein the actuation element comprises at least one of a groove, a cavity dimensioned to receive a tool, a textured surface, or an outwardly-extending tab.

5. The system of claim 1, wherein the striker tang sear is not aligned with the trigger bar sear when the striker tang sear is at the second tang sear position.

* * * * *